United States Patent [19]

Keyworth et al.

[11] 4,191,588

[45] Mar. 4, 1980

[54] METHOD OF CLEANING FOULED HEAT EXCHANGERS AND OTHER EQUIPMENT

[75] Inventors: Donald A. Keyworth, Houston; Jerome R. Sudduth, Pasadena, both of Tex.

[73] Assignee: Tenneco Chemicals, Inc., Saddle Brook, N.J.

[21] Appl. No.: 16,855

[22] Filed: Mar. 2, 1979

[51] Int. Cl.[2] ..... B08B 3/08

[52] U.S. Cl. ..... 134/2; 134/22 R; 134/26; 134/30

[58] Field of Search ..... 134/2, 22 R, 26, 30; 252/172; 122/401; 208/48 R, 48 AA, 262; 260/488 A, 438.1; 165/5, 95; 55/96, 242

[56] References Cited

U.S. PATENT DOCUMENTS

| | | | |
|---|---|---|---|
| 3,256,307 | 6/1966 | Mangham | 260/448 A |
| 3,412,124 | 11/1968 | Moretti et al. | 260/488 A |
| 3,647,843 | 3/1972 | Walker et al. | 260/438.1 |
| 3,651,159 | 3/1972 | Long et al. | 260/438.1 X |
| 3,856,841 | 12/1974 | Merkl | 260/448 A |
| 3,857,869 | 12/1974 | Turnbo | 260/438.1 |
| 4,099,984 | 7/1978 | Christenson et al. | 134/2 |

*Primary Examiner*—Marc L. Caroff
*Attorney, Agent, or Firm*—Evelyn Berlow

[57] ABSTRACT

Heat exchangers and other equipment whose surfaces have become fouled with sludge deposits that comprise a cuprous halide are cleaned by contacting the fouled surfaces of the equipment with a cleaning solution that contains 5% to 35% by weight of an alkyl aluminum halide in a hydrocarbon solution and then washing the surfaces with a hydrocarbon solvent to remove loosened sludge and residual cleaning solution.

10 Claims, No Drawings

METHOD OF CLEANING FOULED HEAT EXCHANGERS AND OTHER EQUIPMENT

This invention relates to a method of cleaning heat exchangers, column packing surfaces, filters, and other equipment that have become fouled with deposits that comprise a cuprous halide. More particularly, it relates to a method of cleaning heat exchangers and other equipment that have become fouled while being used in the removal of carbon monoxide, lower olefins, or other complexible ligands from gas streams by the use of a liquid sorbent that comprises a cuprous aluminum tetrahalide and an aromatic hydrocarbon.

Bimetallic salt complexes that have the generic formula $M_IM_{II}X_n$.Aromatic, wherein $M_I$ is a Group I-B metal, $M_{II}$ is a Group III-A metal, X is halogen, n is the sum of the valences of $M_I$ and $M_{II}$, and Aromatic is a monocyclic aromatic hydrocarbon having 6 to 12 carbon atoms, are known to be useful in the separation from gas mixtures of such complexible ligands as olefins, acetylenes, aromatics, and carbon monoxide. In U.S. Pat. No. 3,651,159, Long et al. disclosed a process in which a sorbent solution of cuprous aluminum tetrahalide in toluene was used to separate ethylene, propylene and other complexible ligands from a feedstream. The complexed ligands were recovered by ligand exchange with toluene. The resulting solution of cuprous aluminum tetrahalide.toluene in toluene was recycled and used to separate additional quantities of the complexible ligands from the feedstream. Walker et al. in U.S. Pat. No. 3,647,843 disclosed a process in which a hydrocarbon pyrolysis gas stream was contacted with a cuprous aluminun tetrachloride solution in toluene to separate acetylene from the gas stream as a solution of the complex $HC{\equiv}CH.CuAlCl_4$ in toluene. Acetylene was stripped from this complex, and the cuprous aluminum tetrachloride.toluene complex was recycled.

In processes such as those disclosed by Long et al. and Walker et al. in which a liquid sorbent that comprises a cuprous aluminum tetrahalide complex is recycled without purification and used for long periods of time, there is a gradual increase in the amounts of reaction by-products and other impurities in the liquid sorbent until there is sufficient impurity present to interfere with the efficient operation of the process. For example, when the liquid sorbent is contacted with a gas stream that contains an olefin having 2 to 4 carbon atoms, some of the olefin undergoes polymerization to form olefin oligomers, and some reacts with the aromatic hydrocarbon in the liquid sorbent to form polyalkylated aromatic compounds. Small amounts of water, hydrogen sulfide, alcohols, ethers, ketones, amines, and certain other impurities in the gas stream react with the cuprous aluminum tetrahalide complex to form complexes. Because these reaction by-products and complexes have limited solubility in the sorbent, they tend to precipitate from the sorbent in the cooler parts of the processing equipment, thereby forming sludge deposits that coat heat exchangers and column packing surfaces, clog filters, and otherwise foul the equipment. When this occurs, it is necessary to purify or discard the liquid sorbent and to remove the sludge deposits from the equipment.

The procedures that have been used heretofore for the removal of sludge deposits from heat exchangers and other equipment are not entirely satisfactory because they are time-consuming and costly to carry out, they do not remove all of the deposited sludge, they cause degradation of the liquid sorbent, or their use results in serious pollution problems. For example, hydroblasting in which the sludge deposits are contacted with water or steam under high pressure requires relatively long periods of down-time, and its use may result in sorbent degradation. The treatment of the deposits with hot toluene does not usually remove a sufficient amount of the sludge from the equipment surfaces, and it makes necessary solvent recovery and purification procedures. In U.S. Pat. No. 4,099,984, Christenson et al. disclosed a process for cleaning fouled heat exchangers that comprises circulating through them a cleaning solution that contains 20% to 80% by weight of a cuprous aluminum tetrahalide.solvent complex and 1% to 15% by weight of an aluminum trihalide for 96 hours or more to remove sludge to the extent possible. Because of its high metal content, the aluminum trihalide-containing liquid sorbent that has been used to clean heat exchangers cannot be discharged into sewers or waste ponds without causing serious pollution problems. Rather, it must be treated by filtration, centrifugation, decantation, or other known methods that will remove solid impurities from it and by more costly and time-consuming procedures to remove the dissolved impurities from it or to recover the metals that it contains. It addition, any of this cleaning solution that remains in the equipment after cleaning or that enters the system that contains the cuprous aluminum tetrachloride sorbent may contain sufficient aluminum trichloride to catalyze the alkylation reaction between olefin impurities in the feed and sorbent or between sorbent molecules themselves to form alkylated aromatic compounds, which interfere with the gas separation process. In our copending application Ser. No. 967,036, which was filed on Dec. 6, 1978, we disclosed a process for cleaning fouled heat exchangers and other equipment that comprises contacting the fouled surfaces with an aqueous ammonium chloride solution for a time sufficient to loosen and/or to dissolve substantially all of the deposited sludge.

This invention relates to an improved method of cleaning processing equipment that has become fouled with sludge deposits that contain a major amount of a cuprous halide. This method is of particular value in cleaning heat exchangers, filters, and other equipment that have become fouled as the result of contact between the surfaces of the equipment and a liquid sorbent that comprises a solution in an aromatic hydrocarbon solvent of a bimetallic salt complex having the structural formula $M_IM_{II}X_n$.Aromatic, which is usually a cuprous aluminum tetrahalide.Aromatic complex. As compared with the previously-known processes for the cleaning of equipment that has been fouled in this way, the present process is simpler, faster, and more economical to operate, it removes more of the foulants, from the equipment, and it does not create pollution problems or require the use of multistep procedures for the disposal or purification of the cleaning solutions that contain the sludge that was removed from the fouled equipment.

The sludge deposits that are removed from processing equipment by the process of this invention contain a major amount of a cuprous halide and minor amounts of one or more inorganic compounds, organic compounds, and/or metalloorganic compounds. When formed during the removal of a complexible ligand from a gas stream by the use of a liquid sorbent that comprises a cuprous aluminum tetrahalide and an aromatic hydrocarbon, the sludge deposits contain a major amount of a cuprous halide that is usually cuprous chloride or cuprous bromide and minor amounts of the complex $CuAlX_4.AlOX$, alkylated aromatic compounds, AlOX, olefin oligomers, and other $CuAlX_4$ complexes, wherein each X represents halogen, usually chlorine or bromine.

In the process of this invention, the fouled surfaces of heat exchangers and other processing equipment are contacted with a solution of an alkyl aluminum halide in a hydrocarbon solvent for a time sufficient to loosen and/or remove substantially all of the deposited sludge. After removal of the cleaning solution from the equipment, loosened sludge and residual cleaning solution are removed by washing the surfaces of the equipment with a hydrocarbon solvent. The equipment that has been cleaned in this way can be returned to service without further treatment.

Unlike the process disclosed by Christenson et al. in U.S. Pat. No. 4,099,984, in which it is necessary that all of the cleaning solution be removed from the cleaned equipment because the aluminum chloride that it contains is known to catalyze alkylation and other side reactions that interfere with the operation of the process in which a liquid sorbent that is a solution of cuprous aluminum tetrahalide in an aromatic hydrocarbon solvent is used to separate complexible ligands from a gas feedstream, the present process does not require complete removal of the cleaning solution before the clean equipment is returned to sevice. Neither the alkyl aluminum halide in the cleaning solution nor the cuprous alkyl aluminum halide that is formed by the reaction of the alkyl aluminum halide with the cuprous halide in the sludge is harmful to the liquid sorbent that is being used to separate complexible ligands from a gas feedstream. Rather, as will be disclosed by Paul C. Ostrowski and David G. Walker in a separate patent application, the presence of small amounts of cuprous alkyl aluminum halide in the cuprous aluminum tetrahalide sorbent is beneficial in that it inhibits alkylation of the aromatic hydrocarbon solvent. The process of this invention is simpler and more economical to carry out than that disclosed in our copending application U.S. Ser. No. 967,036 in that it does not employ an aqueous cleaning solution. When an aqueous solution is used, the clean equipment must be dry before it is returned to service because the cuprous aluminum tetrahalide.aromatic hydrocarbon complex reacts with water to form the complex $CuAlCl_4.AlOCl$.aromatic, which because of its limited solubility in the sorbent can interfere with the efficient operation of the gas-separation process. When the cleaning solution of this invention is used, the equipment need only be washed with a hydrocarbon solvent to remove the loosened sludge before it is returned to service.

In a preferred embodiment of this invention, liquid sorbent that has been used to remove complexible ligands from a gas feedstream is drained from the processing equipment. The last traces of the sorbent may, if desired, be removed by washing the surfaces of the equipment with a hydrocarbon solvent that is preferably toluene or benzene. A solution of an alkyl aluminum halide in a hydrocarbon solvent is circulated through the equipment until substantially all of the sludge on the surfaces of the equipment has been loosened or removed. The alkyl aluminum halide solution is removed, and a hydrocarbon solvent is circulated through the equipment to remove loosened sludge and residual cleaning solution from it.

When a heat exchanger that has been cleaned in this way is returned to service, its efficiency, which had been reduced by fouling, is normal, that is, there is the normal temperature differential ($\Delta T$) and pressure drop across the exchanger.

The cleaning solutions that are used to remove sludge deposits that comprise a cuprous halide from fouled heat exchangers and other processing equipment contain from 5% to 35% by weight, preferably 15% to 25% by weight of an alkyl aluminum halide in a hydrocarbon solvent.

The useful alkyl aluminum halides have the formula $AlR\ X_2$ or the formula $R_3Al_2X_3$, wherein R is alkyl having 1 to 6 carbon atoms and X is a chlorine, bromine, or fluorine atom. The preferred alkyl aluminum halides have the formula $AlR'X'_2$, wherein R' is alkyl having 1 to 4 carbon atoms and X' is chlorine or bromine. Illustrative of the alkyl aluminum halides that can be used in the process of this invention are the following: methyl aluminum dichloride, methyl aluminum dibromide, ethyl aluminum dichloride, ethyl aluminum dibromide, ethyl aluminum difluoride, n-propyl aluminum dichloride, isopropyl aluminum dibromide, n-butyl aluminum dichloride, isobutyl aluminum difluoride, tert.butyl aluminum dibromide, n-hexyl aluminum dichloride, methyl aluminum sesquichloride, ethyl aluminum sesquichloride, ethyl aluminum sesquibromide, isop ropyl aluminum sesquichloride, n-butyl aluminum sesquifluoride, n-hexyl aluminum sesquchloride, and the like. The best results were obtained when the alkyl aluminum halide was ethyl aluminum dichloride or ethyl aluminum dibromide. The hydrocarbon solvents in which the alkyl aluminum halide is dissolved may be an aromatic, aliphatic, or cycloaliphatic hydrocarbon solvent, such as benzene, toluene, xylene, ethylbenzene, pentane, hexane, heptane, propylene, pentene-1, hexene-1, cyclohexene, cyclooctene, and the like. The preferred solvents are aromatic hydrocarbons, such as toluene and benzene.

The amount of the cleaning solution that is used in the process of this invention is not critical provided that the amount of alkyl aluminum halide present is at least equivalent to the amount of cuprous halide in the sludge deposits. In most cases, the amount of cleaning solution used is that which will provide an excess of 10% to 100% of alkyl aluminum halide over the amount that will react with all of the cuprous halide in the sludge.

The cleaning step is usually carried out by circulating the cleaning solution through the fouled equipment at a temperature in the range of 0° C. to 50° C., preferably 20° C. to 40° C., for a time sufficient to loosen or remove substantially all of the deposited sludge. After removal of the cleaning solution from them, the treated portions of the equipment are washed with a hydrocarbon solvent that is preferably toluene or benzene at 10° C. to 70° C., preferably 20° C. to 40° C., to remove the loosened sludge and residual cleaning solution. If desired, the clean equipment can be dried before it is returned to service.

While the mechanism by which the alkyl aluminum halide removes the sludge deposits is not fully understood, it is believed that the cuprous halide in the sludge reacts with the alkyl aluminum halide to form compounds that are soluble in the hydrocarbon solvent; e.g., cuprous chloride reacts with ethyl aluminum dichloride to form cuprous ethyl aluminum trichloride, which is hydrocarbon-soluble. In addition, complex reactions occur between the other components of the sludge and the alkyl aluminun halide that result in the removal or loosening of the remainder of the sludge deposits.

Following their use in the process of this invention, the cleaning solutions can be purified by conventional methods and recycled, or they can be discarded after the solvent, copper and, optionally, aluminum have been recovered from them. Copper can be recovered, for example, by treating the cleaning solution with hydrochloric acid and powdered aluminum. For reasons of economy, cleaning solutions from which the hydrocarbon solvent and copper have been recovered are ordinarily discarded in waste ponds, where they do not cause pollution problems.

In addition to its use in cleaning processing equipment that has become fouled during operation of a process in which complexible ligands are being removed from gas streams with a liquid sorbent that comprises a cuprous aluminum tetrahalide, the process of this invention can be used to clean equipment in which other processes that result in the formation of sludge deposits that comprise cuprous halides have been carried out.

The invention is further illustrated by the examples that follow.

EXAMPLE 1

A heat exchanger that had become fouled with sludge deposits during operation of a process in which a liquid sorbent that was a solution of cuprous aluminum tetrachloride.toluene in toluene was used to remove carbon monoxide from a gas stream was cleaned by the following procedure:

After removal of the liquid sorbent from it, the heat exchanger was washed with toluene to remove residual liquid sorbent. A 25% solution of ethyl aluminum dichloride in toluene was circulated through the tubes of the heat exchanger for 1 hour and then drained from it. The heat exchanger was then washed with toluene at ambient temperature to remove loosened sludge.

When the heat exchanger, which on visual inspection appeared to be clean, was returned to service, its heat transfer characteristics ($\Delta T$) and the pressure drop across it had returned to their normal values.

EXAMPLE 2

A sample of a sludge deposit was taken from the trim cooler outlet of a pilot plant in which cuprous aluminum tetrachloride.benzene was being used to separate ethylene from a gas stream. The sludge, which was found by analysis to contain 70% cuprous chloride, was placed in a nitrogen-purged fritted-glass filter-assembly. Twenty-five milliliters of a 25% by weight solution of ethyl aluminum dichloride in toluene at ambient temperature was used to wash the sludge in a single pass through the filter. The residue was washed with 25 ml. of toluene. By analysis of the residual sludge deposit and of the filtrate, it was determined that 50% of the sludge and 60% of the cuprous chloride in the sludge had been removed by treatment with the ethyl aluminum dichloride cleaning solution.

EXAMPLE 3

A sample of a sludge deposit was removed from an in-line filter on a solvent line between the absorber and the stripper of a pilot plant in which cuprous aluminum tetrachloride.benzene was being used to remove ethylene from a gas stream. The sludge, which was found by analysis to contain 86% cuprous chloride, was placed in a nitrogen-purged fritted-glass filter-assembly and washed with 50 ml. of a 25% by weight solution of ethyl aluminum dichloride in toluene at ambient temperature in a single pass through the filter. Substantially all of the sludge was removed from the filter by this treatment.

What is claimed is:

1. The process for cleaning heat exchangers and other processing equipment whose surfaces have become fouled with sludge deposits that contain a major amount of cuprous halide that comprises contacting the portions of the equipment that contain said sludge deposits with a cleaning solution that contains from 5% to 35% by weight of an alkyl aluminum halide selected from the group consisting of alkyl aluminum dihalides of the formula $AlRX_2$ and alkyl aluminum sesquihalides of the formula $R_3Al_2X_3$, wherein R is alkyl having 1 to 6 carbon atoms and X is chlorine, bromine, or fluorine, in a hydrocarbon solvent at a temperature in the range of 0° C. to 50° C. until substantially all of the deposited sludge has been loosened or removed and washing said portions of the equipment with a hydrocarbon solvent at a temperature in the range of 10° C. to 70° C. to remove loosened sludge and residual cleaning solution.

2. The process of claim 1 wherein the cleaning solution contains 5% to 35% by weight of an alkyl aluminum dihalide in an aromatic hydrocarbon solvent.

3. The process of claim 1 wherein the cleaning solution contains 15% to 25% by weight of an alkyl aluminum dihalide of the formula $AlR'X'_2$, wherein R' is alkyl having 1 to 4 carbon atoms and X' is chlorine or bromine, in an aromatic hydrocarbon solvent.

4. The process of claim 1 wherein the cleaning solution contains 15% to 25% by weight of ethyl aluminum dichloride in toluene.

5. The process of claim 1 wherein the fouled portions of the equipment are contacted with the cleaning solution at a temperature in the range of 20° C. to 40° C.

6. The process of claim 1 wherein the portions of the equipment that have been contacted with said cleaning solution are washed with a hydrocarbon solvent at a temperature in the range of 20° C. to 40° C.

7. The process of claim 1 wherein the portions of the equipment that have been contacted with said cleaning solution are washed with toluene.

8. The process of claim 1 wherein the amount of cleaning solution used is that which contains an amount of alkyl aluminum halide that is at least equivalent to the amount of cuprous halide in the sludge deposits.

9. The process of claim 1 wherein the amount of cleaning solution used is that which will provide an excess of 10% to 100% of alkyl aluminum halide over the amount that will react with the cuprous halide in the sludge deposits.

10. The process of claim 1 wherein the equipment surfaces that are to be cleaned have become fouled with sludge deposits during the passage through said equipment of a liquid sorbent that comprises a cuprous aluminum tetrahalide in an aromatic hydrocarbon solvent.

* * * * *